US008584331B2

(12) United States Patent
Dolan et al.

(10) Patent No.: US 8,584,331 B2
(45) Date of Patent: Nov. 19, 2013

(54) IN SITU FLEXIBLE CIRCUIT EMBOSSING TO FORM AN ELECTRICAL INTERCONNECT

(75) Inventors: Bryan R Dolan, Rochester, NY (US); Peter J Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/232,465

(22) Filed: Sep. 14, 2011

(65) Prior Publication Data

US 2013/0061469 A1 Mar. 14, 2013

(51) Int. Cl.

| | |
|---|---|
| ***H04R 17/10*** | (2006.01) |
| ***B41J 2/045*** | (2006.01) |
| ***H05K 3/30*** | (2006.01) |

(52) U.S. Cl.

USPC ..... 29/25.35; 29/890.1; 29/829; 29/844; 174/254; 347/50; 347/68; 347/71; 310/328; 310/365

(58) Field of Classification Search

USPC ..... 29/25.35, 890.1, 829, 830, 844; 174/254, 255, 260; 347/68–72, 50; 310/328, 331, 340, 365

See application file for complete search history.

(56) References Cited

U.S. PATENT DOCUMENTS

| | | | | |
|---|---|---|---|---|
| 6,891,314 | B2 * | 5/2005 | Sato et al. | 310/328 |
| RE39,474 | E * | 1/2007 | Hashizume et al. | 29/25.35 |
| 2006/0042826 | A1 * | 3/2006 | Kondo | 174/255 |
| 2008/0313895 | A1 * | 12/2008 | Higuchi et al. | 29/25.35 X |

FOREIGN PATENT DOCUMENTS

JP 05169655 A * 7/1993

OTHER PUBLICATIONS

"Electrical Interconnect Using Embossed Contacts on a Flex Circuit", U.S. Appl. No. 12/795,605, filed Jun. 7, 2010.

"High Density Electrical Interconnect for Printing Devices Using Flex Circuit and Dielectric Underfill", U.S. Appl. No. 13/097,162, filed Apr. 29, 2011.

* cited by examiner

*Primary Examiner* — A. Dexter Tugbang

(74) *Attorney, Agent, or Firm* — MH2 Technology Law Group LLP

(57) ABSTRACT

A method of forming a structure such as a print head or a printer including the print head having a flex circuit with a plurality of deformed (i.e., contoured, shaped, or embossed) conductive flexible printed circuit (flex circuit) pads. A plurality of flex circuit pads can be aligned with a plurality of piezoelectric elements of an ink jet print head. Within a press such as a stack press, pressure can be applied to deform the plurality of flex circuit pads and to establish electrical contact between the plurality of flex circuit pads and the plurality of piezoelectric elements. Deforming the plurality of flex circuit pads in situ during the press operation can reduce costs by eliminating a separate embossing stage performed during the manufacture or formation of the flex circuit.

18 Claims, 10 Drawing Sheets

IN SITU FLEXIBLE CIRCUIT EMBOSSING TO FORM AN ELECTRICAL INTERCONNECT

FIELD OF THE EMBODIMENTS

The present teachings relate to the field of ink jet printing devices and, more particularly, to methods of making a high density piezoelectric ink jet print head and a printer including a high density piezoelectric ink jet print head.

BACKGROUND OF THE EMBODIMENTS

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet print heads typically include a flexible diaphragm and an array of piezoelectric elements (i.e., transducers or actuators) attached to the diaphragm. When a voltage is applied to a piezoelectric element, typically through electrical connection with an electrode electrically coupled to a voltage source, the piezoelectric element bends or deflects, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. One way to increase the resolution is to increase the density of the piezoelectric elements.

To attach an array of piezoelectric elements to pads or electrodes of a flexible printed circuit (flex circuit) or to a printed circuit board (PCB), a quantity (i.e., a microdrop) of conductor such as conductive epoxy, conductive paste, or another conductive material is dispensed individually on the top of each piezoelectric element. Electrodes of the flex circuit or PCB are placed in contact with each microdrop to facilitate electrical communication between each piezoelectric element and the electrodes of the flex circuit or PCB.

As resolution and density of the print heads increase, the area available to provide electrical interconnects decreases. Routing of other functions within the head, such as ink feed structures, compete for this reduced space and place restrictions on the types of materials used. Methods for manufacturing a print head having electrical contacts which are easier to manufacture than prior structures, and the resulting print head, would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for forming an ink jet print head including placing a jet stack subassembly having a plurality of piezoelectric elements into a press, aligning a flexible printed circuit (flex circuit) having a plurality of conductive pads with the plurality of piezoelectric elements, and applying pressure to the flex circuit within the press to deform the plurality of conductive pads wherein, during deformation of the plurality of conductive pads within the press, electrical contact is established between the plurality of conductive pads and the plurality of piezoelectric elements.

Another embodiment of the present teachings can include a method for forming a printer including forming an ink jet print head using a method including placing a jet stack subassembly having a plurality of piezoelectric elements into a press, aligning a flexible printed circuit (flex circuit) having a plurality of conductive pads with the plurality of piezoelectric elements, and applying pressure to the flex circuit within the press to deform the plurality of conductive pads. During deformation of the plurality of conductive pads within the press, electrical contact is established between the plurality of conductive pads and the plurality of piezoelectric elements. The method can further include enclosing the print head within a printer housing.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
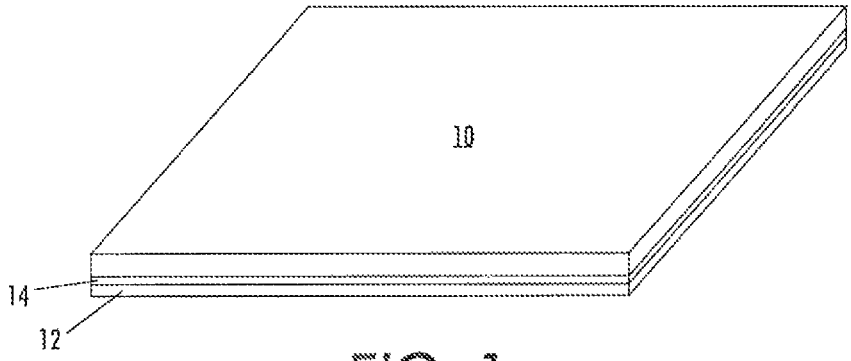
FIGS. 1 and 2 are perspective views of intermediate piezoelectric elements of an in-process device in accordance with an embodiment of the present teachings.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the present embodiments of the present teachings, examples of which are illustrated in the accompanying drawings. Wherever possible, the same reference numbers will be used throughout the drawings to refer to the same or like parts.

As described above, an electrical signal can be passed to each piezoelectric element of an array of piezoelectric elements using a plurality of pads on a flex circuit or a printed circuit board. Typically, the pads are flat and are electrically connected to the piezoelectric elements using a metal solder, metal filled epoxy, or z-axis conductor. Another type of connection, described in commonly assigned U.S. patent application Ser. No. 12/795,605 titled "Electrical Interconnect Using Embossed Contacts On A Flex Circuit," filed Jun. 7, 2010, the disclosure of which is incorporated herein by reference in its entirety, describes the use of a plurality of pads on a flex circuit which are pre-formed, for example, by embossing during formation of the flex circuit to form a plurality of contoured flex circuit bump electrodes (i.e., flex circuit pads). Each bumped electrode is electrically coupled with a unique piezoelectric element using a conductor. Once the electrical connection is complete, the flex circuit can be underfilled as described in commonly assigned U.S. patent application Ser. No. 13/097,182 titled "High Density Electrical Interconnect for Printing Devices Using Flex Circuit and Dielectric Underfill," filed Apr. 29, 2011, the disclosure of which is incorporated herein by reference in its entirety.

Embodiments of the present teachings can simplify the manufacture of a jet stack for a print head, which can be used as part of a printer. Further, the present teachings can result in simplified connection to a transducer array, particularly as transducer arrays continue to become more dense in order to increase print resolution. The present teachings can include a method for electrically coupling an array of flex circuit pads to an array of piezoelectric elements. In an embodiment, the array of flex circuit pads can be embossed (i.e., pre-formed, bumped, or coined) during the electrical interconnection with the array of piezoelectric elements. In situ embossing the pads during the electrical connection of the array of flex circuit pads to the array of piezoelectric elements, for example within a stack press, rather than in advance during a preparatory formation of the flex circuit eliminates a separate pad forming stage, can simplify processing, and can reduce production costs.

An embodiment of the present teachings can include the formation of a jet stack, a print head, and a printer including the print head. In the perspective view of FIG. 1, a piezoelectric element layer 10 is detachably bonded to a transfer carrier 12 with an adhesive 14. The piezoelectric element layer 10 can include, for example, a lead-zirconate-titanate layer, for example between about 25 μm to about 150 μm thick to function as an inner dielectric. The piezoelectric element layer 10 can be plated on both sides with nickel, for example, using an electroless plating process to provide conductive layers on each side of the dielectric PZT. The nickel-plated PZT functions essentially as a parallel plate capacitor which develops a difference in voltage potential across the inner PZT material. The carrier 12 can include a metal sheet, a plastic sheet, or another transfer carrier. The adhesive layer 14 which attaches the piezoelectric element layer 10 to the transfer carrier 12 can include a dicing tape, thermoplastic, or another adhesive. In another embodiment, the transfer carrier 12 can be a material such as a self-adhesive thermoplastic layer such that a separate adhesive layer 14 is not required.

Figure 2:
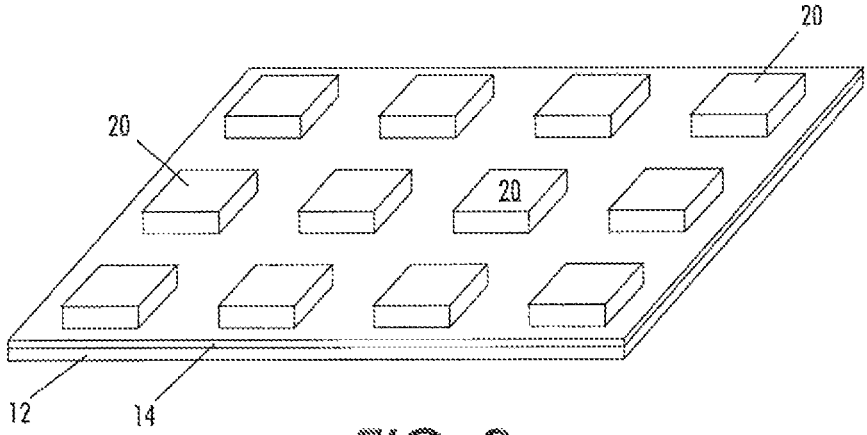

After forming the FIG. 1 structure, the piezoelectric element layer 10 is diced to form a plurality of individual piezoelectric elements 20 as depicted in FIG. 2. It will be appreciated that while FIG. 2 depicts 4×3 array of piezoelectric elements, a larger array can be formed. For example, current print heads can have a 344×20 array of piezoelectric elements. The dicing can be performed using mechanical techniques such as with a saw such as a wafer dicing saw, using a dry etching process, using a laser ablation process, etc. To ensure complete separation of each adjacent piezoelectric element 20, the dicing process can terminate after removing a portion of the adhesive 14 and stopping on the transfer carrier 12, or after dicing through the adhesive 14 and part way into the carrier 12.

Figure 3:
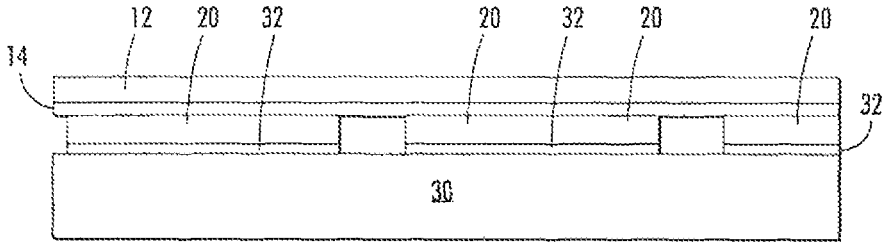
FIGS. 3-9 are cross sections depicting the formation of a jet stack for an ink jet print head.

After forming the individual piezoelectric elements 20, the FIG. 2 assembly can be attached to a jet stack subassembly 30 as depicted in the cross section of FIG. 3. The FIG. 3 cross section is magnified from the FIG. 2 structure for improved detail, and depicts cross sections of one partial and two complete piezoelectric elements 20. The jet stack subassembly 30 can be manufactured using known techniques in any number of jet stack designs, and is depicted in block form for simplicity. In an embodiment, the FIG. 2 structure can be attached to the jet stack subassembly 30 using an adhesive 32. For example, a measured quantity of adhesive 32 can be dispensed, screen printed, rolled, etc., onto either the upper surface of the piezoelectric elements 20, onto a surface of the jet stack subassembly 30, or both. In an embodiment, a single drop of adhesive can be placed onto a surface of the jet stack subassembly 30 for each individual piezoelectric element 20. After applying the adhesive 32, the jet stack subassembly 30 and the piezoelectric elements 20 are aligned with each other, then the piezoelectric elements 20 are mechanically connected to the jet stack subassembly 30 with the adhesive 32. The adhesive 32 is cured by techniques appropriate for the adhesive to result in the FIG. 3 structure.

Figure 4:
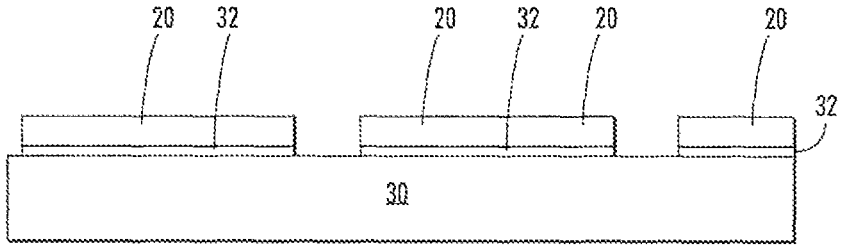

Subsequently, the transfer carrier 12 and the adhesive 14 are removed from the FIG. 3 structure to result in the structure of FIG. 4.

Next, a patterned standoff layer 50 can be formed over the top surface of each piezoelectric element 20 as depicted. The standoff layer 50 can include a patterned pre-formed stencil which is aligned with, and applied to, the top surface of the piezoelectric element array 20. In another embodiment, the standoff layer 50 can be formed as a blanket layer which is patterned and etched to expose the top surface of each piezoelectric element 20. The completed standoff layer 50 can be between about 1 μm and about 100 μm thick, or between about 10 μm and about 50 μm, or between about 15 μm and about 30 μm. In other words, a top surface of the standoff layer 50 is between about 1 μm and about 100 μm or between about 10 μm and about 50 μm, or between about 15 μm and about 30 μm above a top surface of each piezoelectric element 20.

Figure 5:
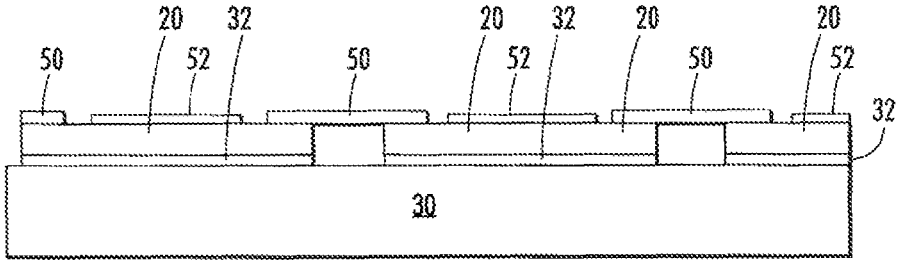

After forming the standoff layer 50, a conductor 52 can applied to a top surface of each piezoelectric element 20 as depicted in FIG. 5. The conductor 52 can be a conductive paste, a metal, a metal alloy, a conductive epoxy, or another conductor, and can be dispensed by any suitable techniques such as by screen printing, drop application, spraying, sputtering, chemical vapor deposition, etc. In an embodiment, the standoff layer 50 can contain the flow of a quantity of flowable conductor 52 across the top surface of each piezoelectric element 20 to reduce the possibility of electrical shorting of adjacent piezoelectric elements 20.

Figure 6:
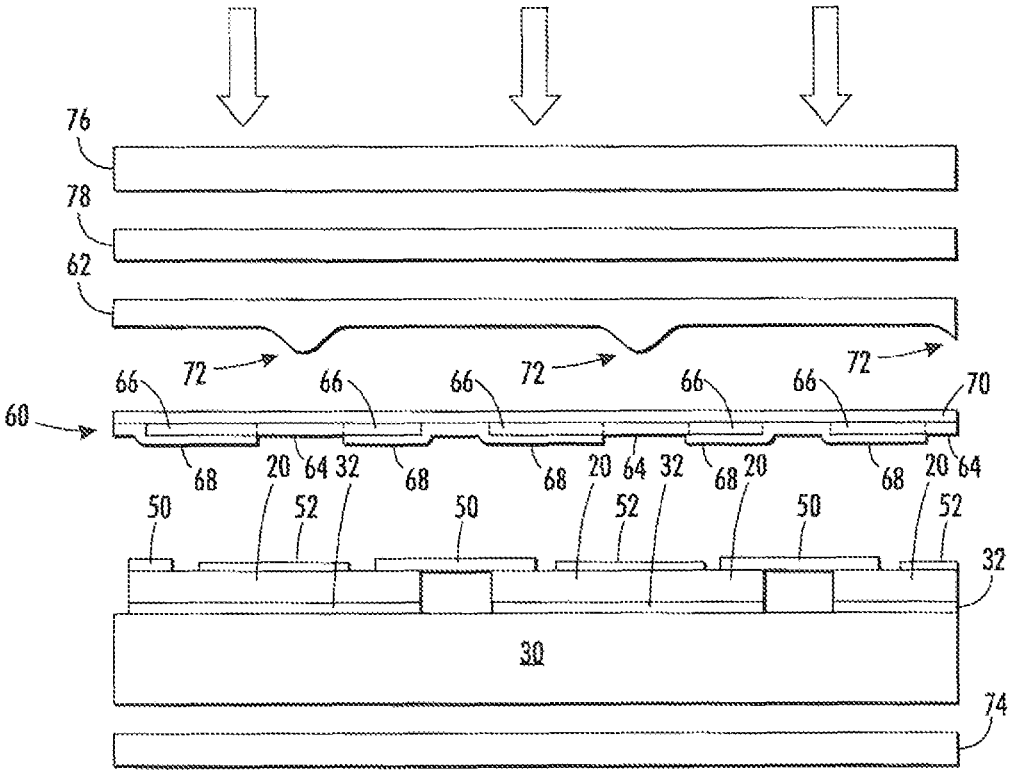

Next, a flex circuit 60 is interposed between the FIG. 5 structure and an arrayed die 62 such as an embossing die as depicted in the exploded cross section of FIG. 6. Various designs of flex circuits 60 are contemplated. In an embodiment, the flex circuit 60 can include an array of pads 64 which are continuous with a plurality of traces 66 interposed between a first dielectric layer 68 (i.e., a solder mask) and a second dielectric layer 70.

The arrayed die 62 can be formed from any suitably rigid material such as metal, for example 316L stainless steel, which is chemically etched or selectively plated to form a suitable array of patterned bumps 72. The material of the arrayed die 62 should be sufficient to withstand pressure and heat placed upon the material within a stack press. Other materials which may function sufficiently for the arrayed die 62 may include manufactured materials such as molded plastics, resins, nylons, etc.

In an embodiment, the flex circuit 60 is interposed between the FIG. 5 structure and the arrayed die 62 within a stack press. The stack press can include a bottom plate 74 and a top plate 76. In another embodiment, a compliant bonding pad 78 can be placed between the arrayed die 62 and the stack press top plate 76 to help insure that the press pressure is evenly distributed across the surface of the arrayed die 62.

Figure 7:
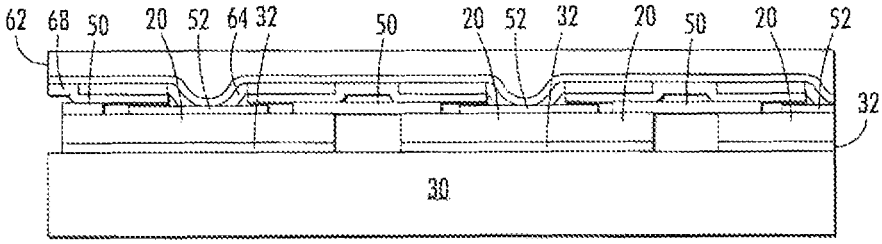

Once the FIG. 5 structure, the flex circuit 60, and the arrayed die 62 are placed into the stack press as depicted in FIG. 6, sufficient pressure is applied to the arrayed die 62 to deform (i.e., to contour or shape) the flex circuit as depicted in FIG. 7. FIG. 7 depicts the FIG. 5 structure after attachment and deformation of the flex circuit 60, after removal of the compliant pad 78 if used, before removal of the arrayed die 62, and after removal from the stack press. The pressure exerted by the press deflects the array of flex circuit pads 64 and, depending on the flex circuit design, can deform the traces 66 as depicted. In an embodiment, a pressure of between about 25 psi and about 300 psi can be applied to the arrayed die 62 to emboss the flex circuit 60. Insufficient pressure can result in incomplete embossing of the flex circuit pads 64, and can result in an electrical open between the pads 64 and the piezoelectric elements 20, while excessive pressure can damage the piezoelectric elements 20 or other jet stack features.

During the application of pressure within the press, heat can be applied to cure the conductor 52, depending on the conductor used. In another embodiment, the conductor 52 can be heated and cooled while in the press, for example if the conductor is a metal solder, to result in electrical coupling of the flex circuit pads 64 to the transducers 20. In yet another embodiment, the conductor 52 can be heated and/or cured after the flex circuit 60 is removed from the press.

Figure 8:
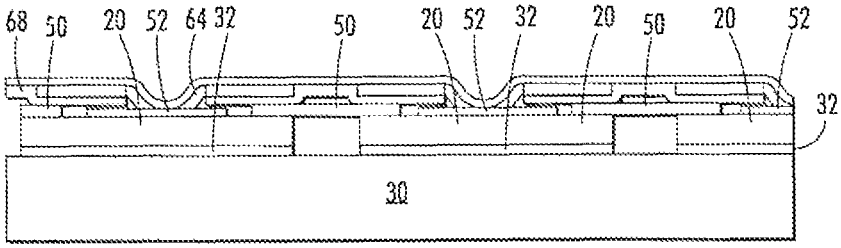

Subsequently, the arrayed die 62 is removed to result in a structure similar to that depicted in FIG. 8. In this embodiment, the conductor 52 can facilitate electrical coupling between each flex circuit pad 64 and a piezoelectric element 20. In addition, if the flex circuit has a propensity to return to its original flatter shape, the conductor can secure each flex circuit pad 64 into electrical contact with one of the piezoelectric elements 20.

Figure 9:
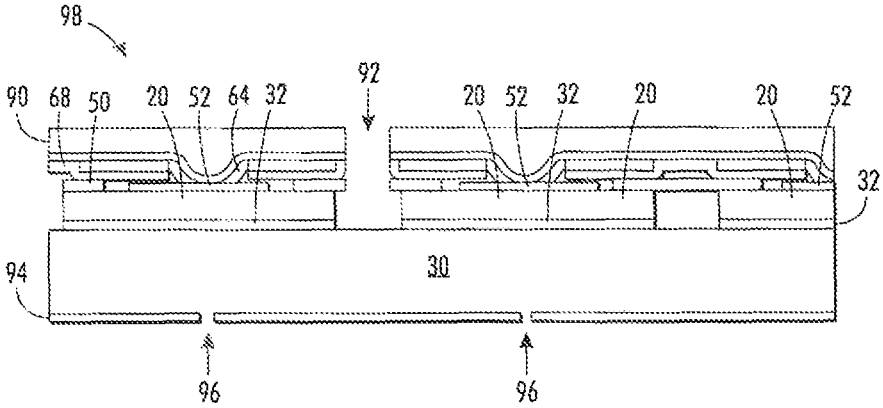

Next, additional processing can be performed, depending on the design of the device. The additional processing can include, for example, the formation of one or more additional layers which can be conductive, dielectric, patterned, or continuous, and which are represented together schematically by layer 90 as depicted in FIG. 9.

Next, various processing stages can be performed to complete the jet stack, depending on the design of the jet stack subassembly 30. For example, one or more ink port openings 92 can be formed through layer 90 as depicted in FIG. 9. Further, depending on the design of the device, the ink port opening 92 can be formed through a portion of the flex circuit 60, as long as the opening 92 does not result in an electrical open or other undesirable effects. If the ink port opening 92 is formed at the depicted location, the opening 92 can extend through the jet stack subassembly, for example through a jet stack diaphragm. In another embodiment, one or more ink port openings may be formed at a non-depicted location where the flex circuit 60 and/or the piezoelectric array 20 do not reside. In an embodiment, an aperture plate 94 can be attached to the jet stack subassembly 30 with an adhesive (not individually depicted for simplicity) as depicted in FIG. 9. The aperture plate 94 can include a plurality of nozzles 96 through which ink is expelled during printing. Once the aperture plate 94 is attached, the jet stack 98 is complete. A jet stack 98 can include other layers, other designs, other openings, and additional processing requirements which are not depicted or described for simplicity.

Figure 10:
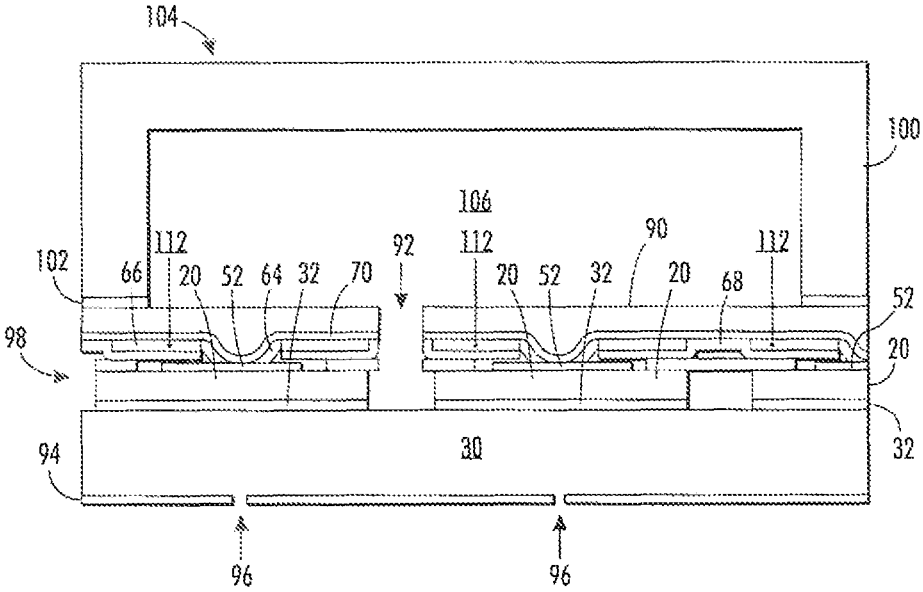
FIG. 10 is a cross section of a print head including the jet stack of FIG. 9.

Next, a manifold 100 can be bonded to the upper surface of the jet stack 98, which physically attaches the manifold 100 to the jet stack 98. The attachment of the manifold 100 can include the use of a fluid-tight sealed connection 102 such as an adhesive to result in an ink jet print head 104 as depicted in FIG. 10. The ink jet print head 104 can include an ink reservoir 106 formed by a surface of the manifold 100 and the upper surface of the jet stack 98 for storing a volume of ink. Ink from the reservoir 106 is delivered through ports 92 in the jet stack 98, wherein the ink ports are provided, in part, by a continuous opening through any overlying layer 90, the flex circuit 60, the standoff layer 50, and through the jet stack subassembly 30. It will be understood that FIG. 10 is a simplified view. An actual print head may include various structures and differences not depicted in FIG. 10, for example additional structures to the left and right, which have not been depicted for simplicity of explanation. While FIG. 10 depicts two ports 92, a 600 DPI jet stack may include more than two ports.

In use, the reservoir 106 in the manifold 100 of the print head 104 includes a volume of ink. An initial priming of the print head can be employed to cause ink to flow from the reservoir 106, through the ports 92 in the jet stack 98. Responsive to a voltage 112 placed on each trace 66 which is transferred to a pad 64 of the flex circuit pad array, to the conductor 52, and to the piezoelectric electrodes 20, each PZT piezoelectric element 20 bends or deflects at an appropriate time in response. The deflection of the piezoelectric element 20 causes a diaphragm (not individually depicted) which is part of the jet stack 98 to flex which creates a pressure pulse within the jet stack, causing a drop of ink to be expelled from the nozzle 96.

The methods and structure described above thereby form a jet stack 98 for an ink jet printer. In an embodiment, the jet stack 98 can be used as part of an ink jet print head 120 as depicted in FIG. 11.

Figure 11:
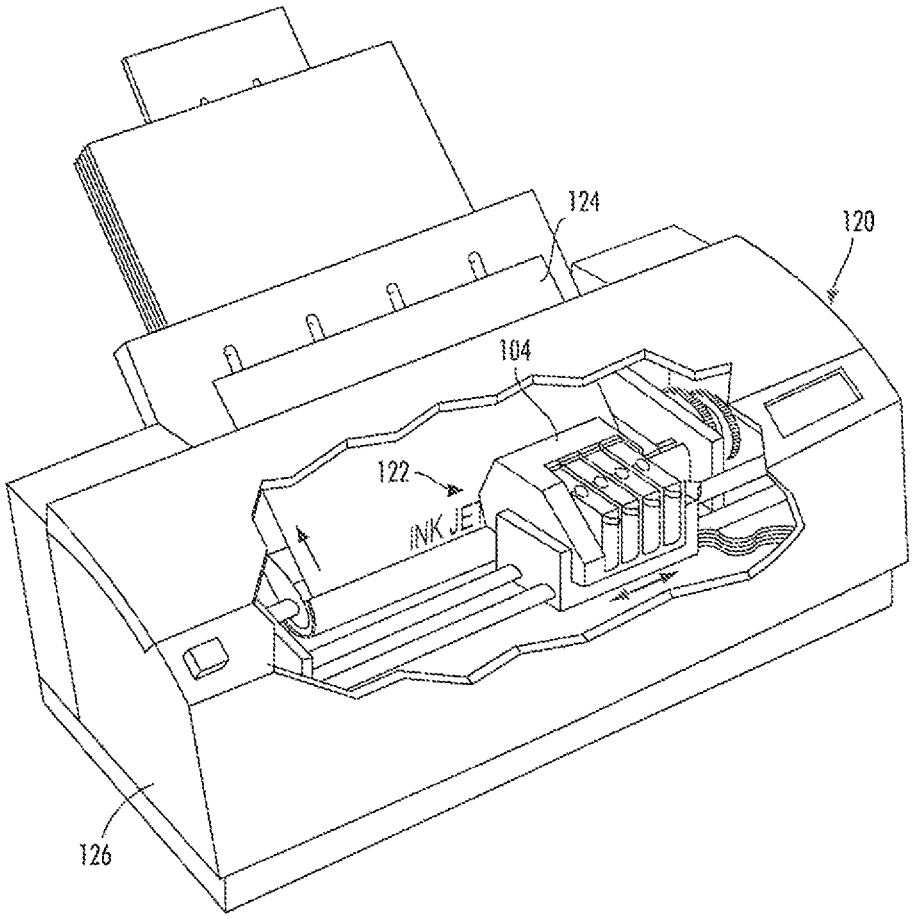
FIG. 11 is a printing device including a print head according to an embodiment of the present teachings.

FIG. 11 depicts a printer 120 including one or more print heads 104 and ink 122 being ejected from one or more nozzles 96 in accordance with an embodiment of the present teachings. Each print head 104 is configured to operate in accordance with digital instructions to create a desired image on a print medium 124 such as a paper sheet, plastic, etc. Each print head 104 may move back and forth relative to the print medium 124 in a scanning motion to generate the printed image swath by swath. Alternately, the print head 104 may be held fixed and the print medium 124 moved relative to it, creating an image as wide as the print head 104 in a single pass. The print head 104 can be narrower than, or as wide as, the print medium 124. The printer hardware can be enclosed in a printer housing 126. In another embodiment, the print head can print to an intermediate surface such as a rotating drum or belt for subsequent transfer to a print medium.

Figure 12A:
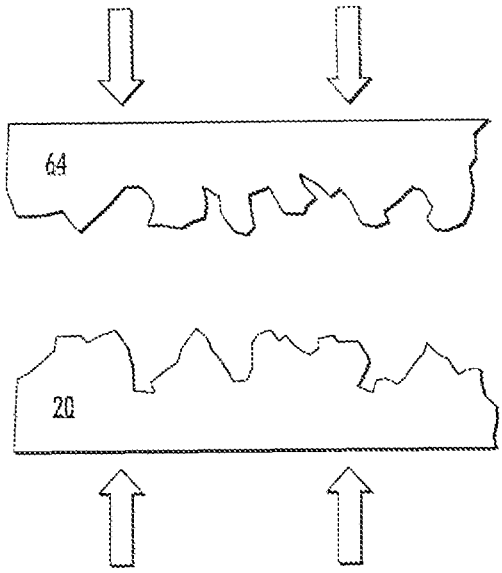
FIGS. 12-16 are cross sections depicting the formulation of a jet stack for an ink jet print head according to other embodiments of the present teachings.
Figure 12B:
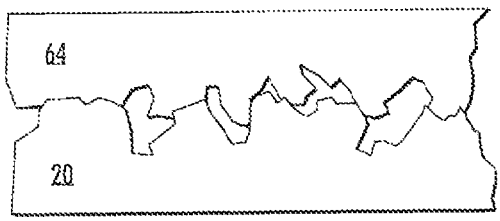
Figure 13:
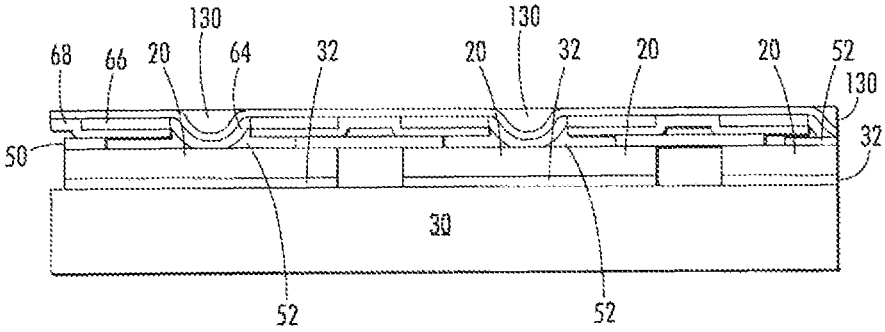

In an alternate embodiment as depicted in FIGS. 12A and 12B, a conductor is not used, but electrical contact is established through asperity contact. U.S. patent application Ser. No. 13/097,182, which was incorporated by reference above, also describes an asperity contact. In this embodiment, the flex circuit 60 as depicted in FIG. 6 can be formed such that pads 64 and piezoelectric element 20 include a plurality of surface asperities as depicted in the magnified view of FIGS. 12A, 12B. The asperities on the plurality of flex circuit pads 64 can be formed as a natural surface roughness of the material or materials from which the pads 64 are formed, and can have an average height from less than 1.0 μm to about 3.0 μm. Subsequently, an arrayed die 62 as described above is used to emboss the flex circuit pads 64 as depicted in FIG. 13. In this embodiment, no additional conductor is interposed between the pad 64 and the piezoelectric element 20. Physical contact between the surface asperities on the flex circuit pads 64 and the surface asperities on the piezoelectric elements 20 is relied on to provide electrical coupling and establish electrical communication between the pads 64 and the piezoelectric elements 20. That is, conductive paths between the plurality of flex circuit pads 64 and the plurality of piezoelectric elements 20 is provided through direct physical contact between the two structures.

FIG. 13 further depicts the use of an optional material 130 which can be used with any of the embodiments of the present teachings. For example, if high stress has not induced plastic deformation, or if yield strength has not be achieved, an optional material 130 such as an epoxy or adhesive can be used above the top surface of the actuator 20 to avoid reversible deformation and to maintain electrical contact between the pads 64 and the piezoelectric elements 20. The optional material 130 can be formed only within depressions or dimples in the flex circuit 60 which result from the embossing process as depicted in FIG. 13. In another embodiment, the material 130 can be formed across the entire top surface of the FIG. 8 structure, and can thus take a form similar to that of layer 90 in FIG. 9.

In another alternate embodiment, material 52 as depicted in FIGS. 5-10 can be a nonconductive material used as an adhesive and not as a conductor. The material can be, for example, a nonconductive epoxy. In an embodiment where material 52 is a nonconductor, electrical contact can be established through asperity contact as described above, and the nonconductor would physically secure the embossed flex circuit pads 64 in electrical contact to the piezoelectric elements 20, for example during electrical operation of the print head. In another embodiment, a nonconductive material 52 can be used along with optional material 130 as described with reference to FIG. 13.

Figure 14:
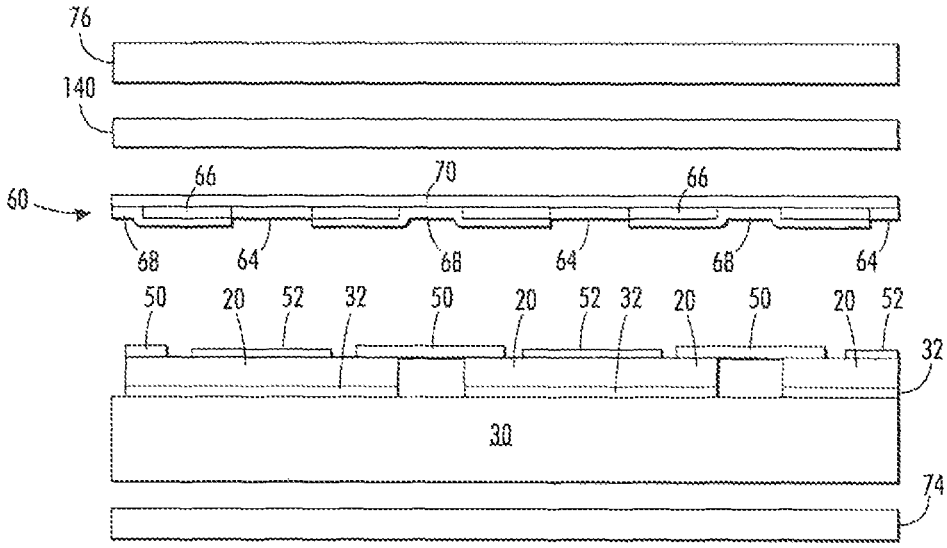
Figure 15:
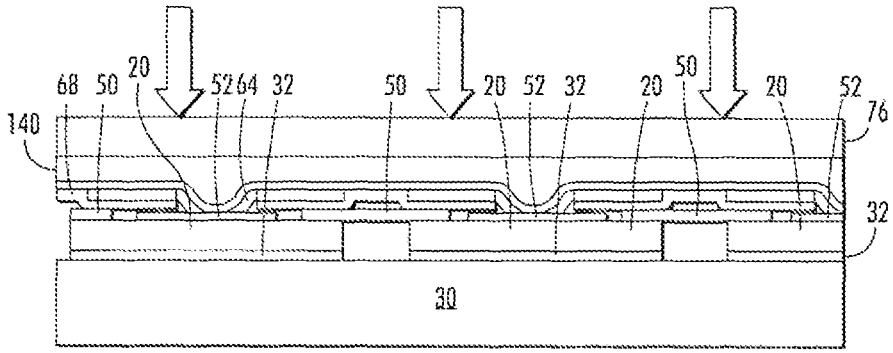
Figure 16:
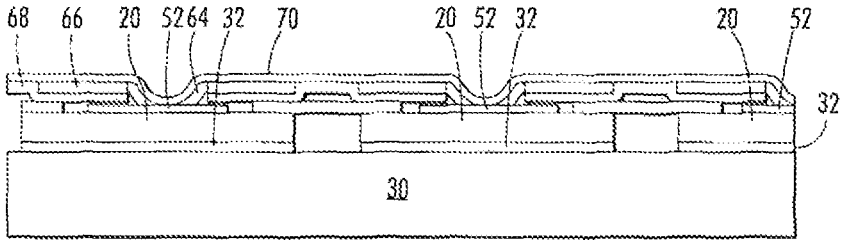

Another embodiment of the present teachings is depicted in FIGS. 14-16. In this embodiment, an arrayed die is not used to form the flex circuit, but rather a compliant pad 140 as depicted in the exploded cross section of FIG. 14 is used. The compliant pad can be a layer of silicone between about 500 μm and about 20 millimeters (mm) thick, or between about 2 mm and about 10 mm thick, or between about 6 mm and about 7 mm thick. A pad which is excessively thick would require excessive pressure to deform in order to contour the flex circuit pads, and a pad which is excessively thin would not sufficiently deform and thus would not contour the flex circuit. As with the FIG. 6 embodiment, the assembly can be placed into a stack press which can include a bottom plate 74 and a top plate 76 as depicted in FIG. 14. A pressure in the range of between about 5 psi and about 500 psi, or between about 10 psi and about 450 psi, or between about 25 psi and about 400 psi can be applied to the assembly by the press, which causes the compliant pad 140 to apply even pressure across the flex circuit. Insufficient pressure can result in incomplete embossing of the flex circuit pads 64, and can result in an electrical open between the pads 64 and the piezoelectric elements 20, while excessive pressure can damage the piezoelectric elements 20 or other jet stack features. During the application of pressure to the compliant pad within the stack press, the compliant pad 140 deforms into the unsupported regions above each actuator 20 as depicted in FIG. 15 to emboss the flex circuit pads 64. FIG. 16 depicts the FIG. 15 jet stack structure after removal from the stack press and after removal of the compliant pad 140. In this embodiment, electrical contact between the array of bump electrodes 64 and the array of piezoelectric elements 20 can be established through asperity contact as depicted in FIGS. 12A and 12B, or a separate conductor can be used.

In the embodiment of FIGS. 14-16, any misalignment of an arrayed die to the flex circuit and to the piezoelectric element array is avoided, as the compliant pad provides self alignment and deflects into the unsupported areas of lower pressure above each of the piezoelectric elements under pressure in the stack press.

Thus various embodiments of the present teachings as described herein can reduce costs by embossing a plurality of flex circuit pads in situ during attachment of the flex circuit to the piezoelectric element array during print head fabrication. Various embodiments of the present teachings create localized regions of high stress to induce deformation in the contact pad areas during bonding. In embodiments of the present teachings, costs can be reduced as the flex circuit is physically contoured during the electrical coupling of the flex circuit to the transducer array rather than during a separate contouring during manufacture of the flex circuit.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein, and some acts or events may be replaced by other acts or events. Also, not all process stages may be required to implement a methodology in accordance with one or more aspects or embodiments of the present teachings. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for forming an ink jet print head, comprising:

placing a jet stack subassembly comprising a plurality of piezoelectric elements into a press;

aligning a plurality of flat, unembossed conductive pads of a flexible printed circuit (flex circuit) with the plurality of piezoelectric elements, wherein the plurality of flat, unembossed conductive pads are continuous with, and formed from a same conductor layer as, a plurality of flex circuit traces; and applying pressure to the flex circuit within the press to deform the plurality of flat, unembossed conductive pads into a plurality of contoured, embossed conductive pads wherein, during deformation of the plurality of flat, unembossed conductive pads within the press, electrical contact is established between the plurality of contoured, embossed conductive pads and the plurality of piezoelectric elements.

2. The method of claim 1, further comprising:

placing an arrayed die between the flex circuit and a press plate; and applying pressure to the flex circuit through contact with the arrayed die within the press to deform the plurality of unembossed conductive pads within the press.

3. The method of claim 1, further comprising:

placing a compliant pad between the flex circuit and a press plate; and applying pressure to the flex circuit through contact with the compliant pad within the press to deform the plurality of unembossed conductive pads within the press.

4. The method of claim 3, further comprising:

applying a standoff layer to the jet stack subassembly, wherein the standoff layer has a plurality of openings therein which expose the plurality of piezoelectric elements;

contacting the standoff layer with the flex circuit within the press; and the compliant pad extends through the plurality of openings within the standoff layer to deform the plurality of unembossed conductive pads within the press.

5. The method of claim 1, further comprising:

applying a conductor to a surface of each piezoelectric element of the plurality of piezoelectric elements; and contacting each of the plurality of embossed conductive pads with the conductor on the surface of each piezoelectric element during the application of pressure to the flex circuit within the press, wherein the electrical contact is established between the plurality of embossed conductive pads and the plurality of piezoelectric elements through contact of the conductor by the plurality of conductive pads and the plurality of piezoelectric elements.

6. The method of claim 1, further comprising:

prior to placing the jet stack subassembly into the press, applying a nonconductive material to a surface of each piezoelectric element of the plurality of piezoelectric elements;

contacting each of the plurality of contoured, embossed conductive pads with the nonconductive material on the surface of each piezoelectric element during the application of pressure to the flex circuit within the press; and curing the nonconductive material during contact with each of the plurality of contoured, embossed conductive pads, wherein the cured nonconductive material maintains physical contact between each of the plurality of contoured, embossed conductive pads and the plurality of piezoelectric elements.

7. The method of claim 6, further comprising contacting a plurality of asperities on each of the plurality of piezoelectric elements with a plurality of asperities formed from the same conductor layer as the plurality of contoured, embossed conductive pads during the application of pressure to the flex circuit within the press, wherein the electrical contact is established between the plurality of contoured, embossed conductive pads and the plurality of piezoelectric elements through contact of the plurality of asperities on each of the plurality of piezoelectric elements with the plurality of surface asperities formed from the same conductor layer as the plurality of contoured, embossed conductive pads.

8. The method of claim 1, further comprising contacting a plurality of asperities on each of the plurality of piezoelectric elements with a plurality of asperities on each of the plurality of embossed conductive pads during the application of pressure to the flex circuit within the press, wherein the electrical contact is established between the plurality of embossed conductive pads and the plurality of piezoelectric elements through contact of the plurality of asperities.

9. The method of claim 1, further comprising applying a pressure of between about 25 psi and about 400 psi to the flex circuit to deform the plurality of unembossed conductive pads.

10. A method for forming a printer, comprising:

forming an ink jet print head using a method comprising:

placing a jet stack subassembly comprising a plurality of piezoelectric elements into a press;

aligning a plurality of flat, unembossed conductive pads of a flexible printed circuit (flex circuit) with the plurality of piezoelectric elements, wherein the plurality of flat, unembossed conductive pads are continuous with, and formed from a same conductor layer as, a plurality of flex circuit traces; and applying pressure to the flex circuit within the press to deform the plurality of flat, unembossed conductive pads into a plurality of contoured, embossed conductive pads wherein, during deformation of the plurality of flat, unembossed conductive pads within the press, electrical contact is established between the plurality of contoured embossed conductive pads and the plurality of piezoelectric elements; and enclosing the print head within a printer housing.

11. The method of claim 10, wherein the formation of the ink jet print head further comprises:

placing an arrayed die between the flex circuit and a press plate; and applying pressure to the flex circuit through contact with the arrayed die within the press to deform the plurality of unembossed conductive pads within the press.

12. The method of claim 10, wherein the formation of the ink jet print head further comprises:

placing a compliant pad between the flex circuit and a press plate; and applying pressure to the flex circuit through contact with the compliant pad within the press to deform the plurality of unembossed conductive pads within the press.

13. The method of claim 12, wherein the formation of the ink jet print head further comprises:

applying a standoff layer to the jet stack subassembly, wherein the standoff layer has a plurality of openings therein which expose the plurality of piezoelectric elements;

contacting the standoff layer with the flex circuit within the press; and the compliant pad extends through the plurality of openings within the standoff layer to deform the plurality of unembossed conductive pads within the press.

14. The method of claim 10, wherein the formation of the ink jet print head further comprises:

applying a conductor to a surface of each piezoelectric element of the plurality of piezoelectric elements; and contacting each of the plurality of embossed conductive pads with the conductor on the surface of each piezoelectric element during the application of pressure to the flex circuit within the press, wherein the electrical contact is established between the plurality of embossed conductive pads and the plurality of piezoelectric elements through contact of the conductor by the plurality of embossed conductive pads and the plurality of piezoelectric elements.

15. The method of claim 10, further comprising:

prior to placing the jet stack subassembly into the press, applying a nonconductive material to a surface of each piezoelectric element of the plurality of piezoelectric elements;

contacting each of the plurality of contoured, embossed conductive pads with the nonconductive material on the surface of each piezoelectric element during the application of pressure to the flex circuit within the press; and curing the nonconductive material during contact with each of the plurality of contoured, embossed conductive pads, wherein the cured nonconductive material maintains physical contact between each of the plurality of contoured, embossed conductive pads and the plurality of piezoelectric elements.

16. The method of claim 15, further comprising contacting a plurality of asperities on each of the plurality of piezoelectric elements with a plurality of asperities formed from the same conductor layer as the plurality of contoured, embossed conductive pads during the application of pressure to the flex circuit within the press, wherein the electrical contact is established between the plurality of contoured, embossed conductive pads and the plurality of piezoelectric elements through contact of the plurality of asperities on each of the plurality of piezoelectric elements with the plurality of surface asperities formed from the same conductor layer as the plurality of contoured, embossed conductive pads.

17. The method of claim 10, wherein the formation of the ink jet print head further comprises contacting a plurality of asperities on each of the plurality of piezoelectric elements with a plurality of asperities on each of the plurality of embossed conductive pads during the application of pressure to the flex circuit within the press, wherein the electrical contact is established between the plurality of embossed conductive pads and the plurality of piezoelectric elements through contact of the plurality of asperities.

18. The method of claim 10, wherein the formation of the ink jet print head further comprises applying a pressure of between about 25 psi and about 400 psi to the flex circuit to deform the plurality of unembossed conductive pads.

* * * * *